US010668999B2

(12) United States Patent
Godoy

(10) Patent No.: US 10,668,999 B2
(45) Date of Patent: Jun. 2, 2020

(54) MASK FOR SURFACE SNORKELING

(71) Applicant: Cressi-Sub S.p.A., Genoa (IT)

(72) Inventor: Carlos Alberto Godoy, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 294 days.

(21) Appl. No.: 15/874,449

(22) Filed: Jan. 18, 2018

(65) Prior Publication Data

US 2019/0002068 A1 Jan. 3, 2019

(30) Foreign Application Priority Data

Jun. 30, 2017 (IT) ..... 102017000073604

(51) Int. Cl.
*B63C 11/16* (2006.01)
*B63C 11/20* (2006.01)

(52) U.S. Cl.
CPC ..... *B63C 11/16* (2013.01); *B63C 11/205* (2013.01); *B63C 2011/165* (2013.01)

(58) Field of Classification Search
CPC ..... B63C 11/06; B63C 11/16; B63C 11/205; B63C 11/12; B63C 11/207; A62B 18/04; A62B 18/10; A62B 33/00
See application file for complete search history.

(56) References Cited

U.S. PATENT DOCUMENTS

| | | | | |
|---|---|---|---|---|
| 9,132,037 | B2 * | 9/2015 | Godoy | B63C 11/12 |
| 2009/0211575 | A1 * | 8/2009 | Shiue | B63C 11/16 128/201.11 |
| 2016/0297505 | A1 * | 10/2016 | Caprice | B63C 11/16 |
| 2018/0319471 | A1 * | 11/2018 | Thomas | B63C 11/16 |

* cited by examiner

*Primary Examiner* — Timothy A Stanis
*Assistant Examiner* — Margaret M Luarca
(74) *Attorney, Agent, or Firm* — Blank Rome LLP

(57) ABSTRACT

The mask for surface snorkeling comprises a rigid frame (2), a transparent visor (3), a soft face mask (4) applicable in an airtight way to the face of the user and having a membrane (7) which delimits an upper viewing chamber (8) being shaped to contain the eyes of the user and a lower breathing chamber (9) being shaped to contain the nose and mouth of the user, and a breathing circuit (5) connected to the lower chamber (9), a ventilation circuit of the upper chamber (8) independent and separated from the breathing circuit (5) also being provided.

20 Claims, 6 Drawing Sheets

MASK FOR SURFACE SNORKELING

RELATED APPLICATIONS

This application claims priority to Italy Application No. 102017000073604, filed Jun. 30, 2014. The above-identified related application is incorporated by reference.

FIELD OF USE

Background of the Invention

The present invention relates to a mask for surface snorkeling.

A mask for surface snorkeling of the known type has a rigid frame, a transparent visor, a soft face mask applicable in an airtight way to the face, a breathing tube with a floating shutter, and a strap to be applied around the head for holding the mask in position.

In a certain type of masks for surface snorkeling now widespread on the market, the visor is configured so as to be applied to the whole oval of the face and for that purpose it has internally a membrane that delimits an upper viewing chamber being shaped to contain the eyes and a lower breathing chamber being shaped to contain the nose and mouth.

In this type of masks it is inevitable that wet air, in particular that produced by breathing, can cause fogging of the visor, reducing the snorkeler's visual capacity.

Various attempts have been made to reduce the onset of fogging of the visor.

CN204173146U discloses a mask of this type wherein the membrane is equipped with at least one check valve that allows the passage of air from the upper chamber to the lower chamber when the pressure difference reaches a pre-fixed value. The breathing tube envisages three parallel conduits: the central, inlet, one places the external environment (air) in communication with the upper chamber. From the upper chamber the air can pass into the lower chamber through the mentioned check valve which is opened by the depression created by the user breathing in. The other two conduits of the breathing tube are connected to two outlet conduits that leave from the lower chamber. When overpressure is generated in the lower chamber of the mask by the user breathing out, the air expired is conveyed into the outlet conduits that lead to the upper end of the breathing tube. The end of the breathing tube finishes with a passage chamber that is in communication with the external air when the floating shutter comes into the opening position. The passage chamber communicates with the three mentioned tubes, one inlet one, for inspiration, and two symmetrical outlet ones, for expiration, through check valves. Therefore, when the user breathes in, the depression he/she has created must overcome the resistance of two check valves placed in series: the check valve between the passage chamber and the descending conduit placed in the breathing tube and the passage check valve between the upper chamber and the lower chamber. When the user breathes out, the pressure created by the user must overcome the resistance of the check valve between the outlet conduit of the breathing tube and the passage chamber. The air which crosses the upper chamber during the inspiration step acts as a wash, i.e. it renews the air present in the upper chamber to reduce any fogging created by the stagnation of the air breathed into the upper chamber.

Other masks of this type are described, for example, in CN204548450U and in WO 2015/170013.

All these types of masks have in common the fact that they include at least one check valve in the breathing circuit.

In fact, to prevent the fogging of the visor the flow of air inspired enters the visor chamber first and then through a check valve it passes into the breathing chamber from where it is subsequently ejected.

Therefore, the breathing circuit includes in series the upper chamber and the lower chamber and the provision of one or more check valves, provided in the separation membrane between the upper chamber and the lower chamber and sometimes also in the passage chamber at the end of the breathing tube, substantially increases the inspiration and expiration effort.

SUMMARY OF THE INVENTION

The technical task of the present invention is therefore to realise a mask for surface snorkeling that prevents the fogging of the visor without increasing the breathing effort.

The technical task, as well as these and other objects, are achieved according to the present invention by providing a mask for surface snorkeling comprising a rigid frame, a transparent visor, a soft face mask applicable in an airtight way to the face of the user and having a membrane which delimits an upper viewing chamber being shaped to contain the eyes of the user and a lower breathing chamber being shaped to contain the nose and mouth of the user, and a breathing circuit connected to said lower chamber, characterised in that it comprises a ventilation circuit of said upper chamber independent and separated from said breathing circuit.

The breathing circuit comprises a first connecting conduit for connecting said lower chamber to the atmospheric environment external to the mask, and said ventilation circuit comprises a second connecting conduit for connecting said upper chamber to the atmospheric environment external to the mask.

Said first and second conduit are equipped with floating shutter means.

Advantageously, along its whole length said first conduit has a free passage section when said shutter means are in the open position thus establishing a direct air connection of said lower chamber with the atmospheric environment external to the mask.

Advantageously, along its whole length, said second conduit also has a free passage section when said shutter means are in the open position thus establishing a direct air connection of said upper chamber with the atmospheric environment external to the mask. Unlike the technical solutions included in the state of the art, the mask in accordance with the invention prevents the fogging of the visor without increasing the effort made for breathing since no check valves are provided that need to be opened for connection with the external atmospheric environment, given that the connection of the lower chamber with the external atmospheric environment is direct when the floating shutter means are in the open position.

The ventilation process is also effective, not implying the opening of a check valve as the connection of the upper chamber with the external atmospheric environment is also direct when the floating shutter means are in the open position.

The fogging of the visor is therefore prevented without creating an air circuit that crosses the upper chamber and the lower chamber in series. Therefore, it has been unexpectedly seen that it is sufficient to place the upper chamber in free communication with the atmospheric environment external to the mask to prevent the fogging of the visor.

On the other hand, when during surface snorkeling the head of the user is submerged temporarily the floating shutter means in the closed position prevent water from entering both into the viewing chamber and into the breathing chamber.

BRIEF DESCRIPTION OF THE DRAWINGS

Further characteristics and advantages will become more apparent from the following detailed description of an embodiment of the surface snorkeling mask according to the invention, illustrated by way of non-limiting example in the accompanying figures, wherein.

DETAILED DESCRIPTION OF THE ILLUSTRATED EMBODIMENTS

Figure 1:
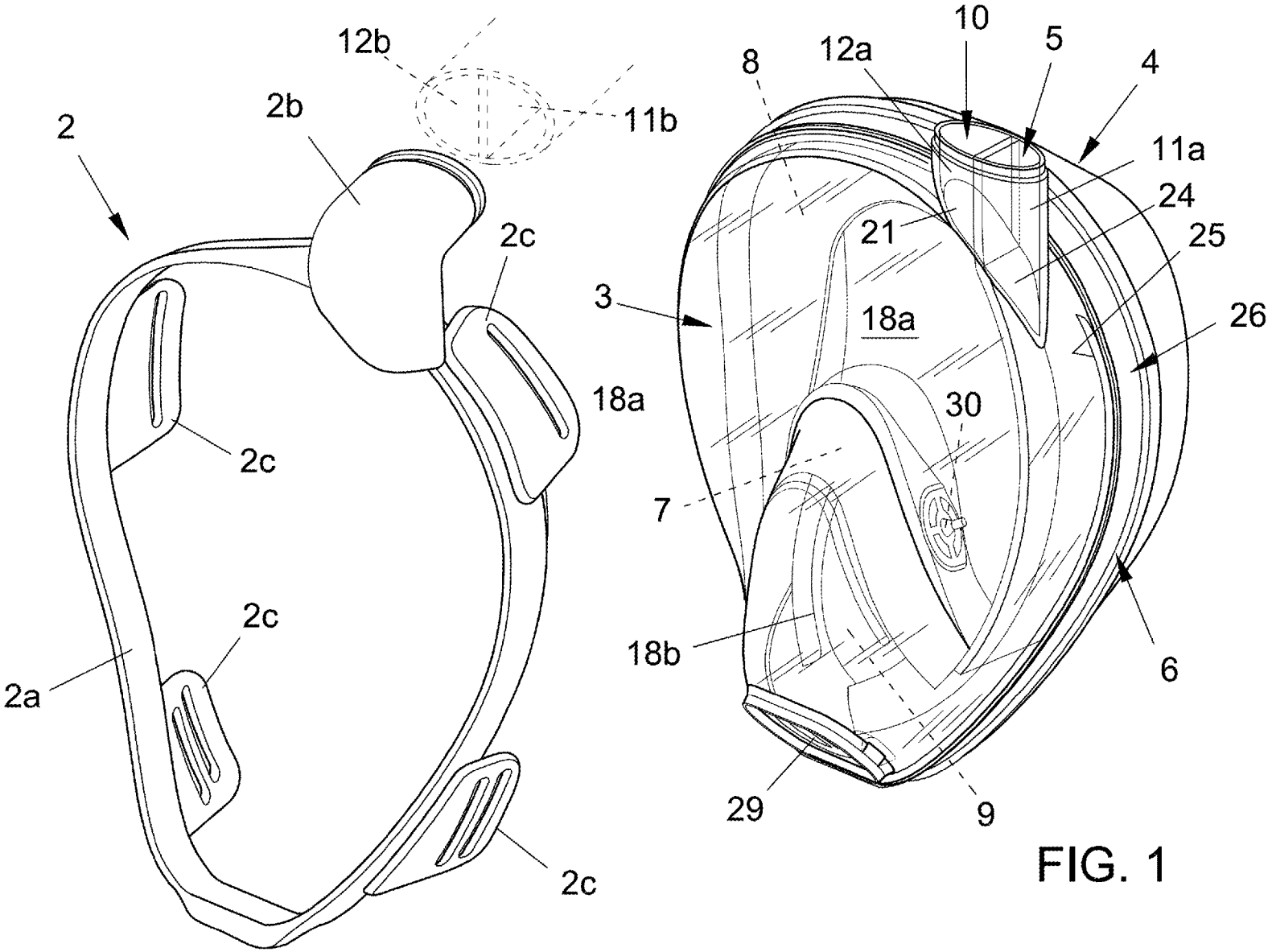
FIG. 1 shows an exploded view of the mask.
Figure 2:
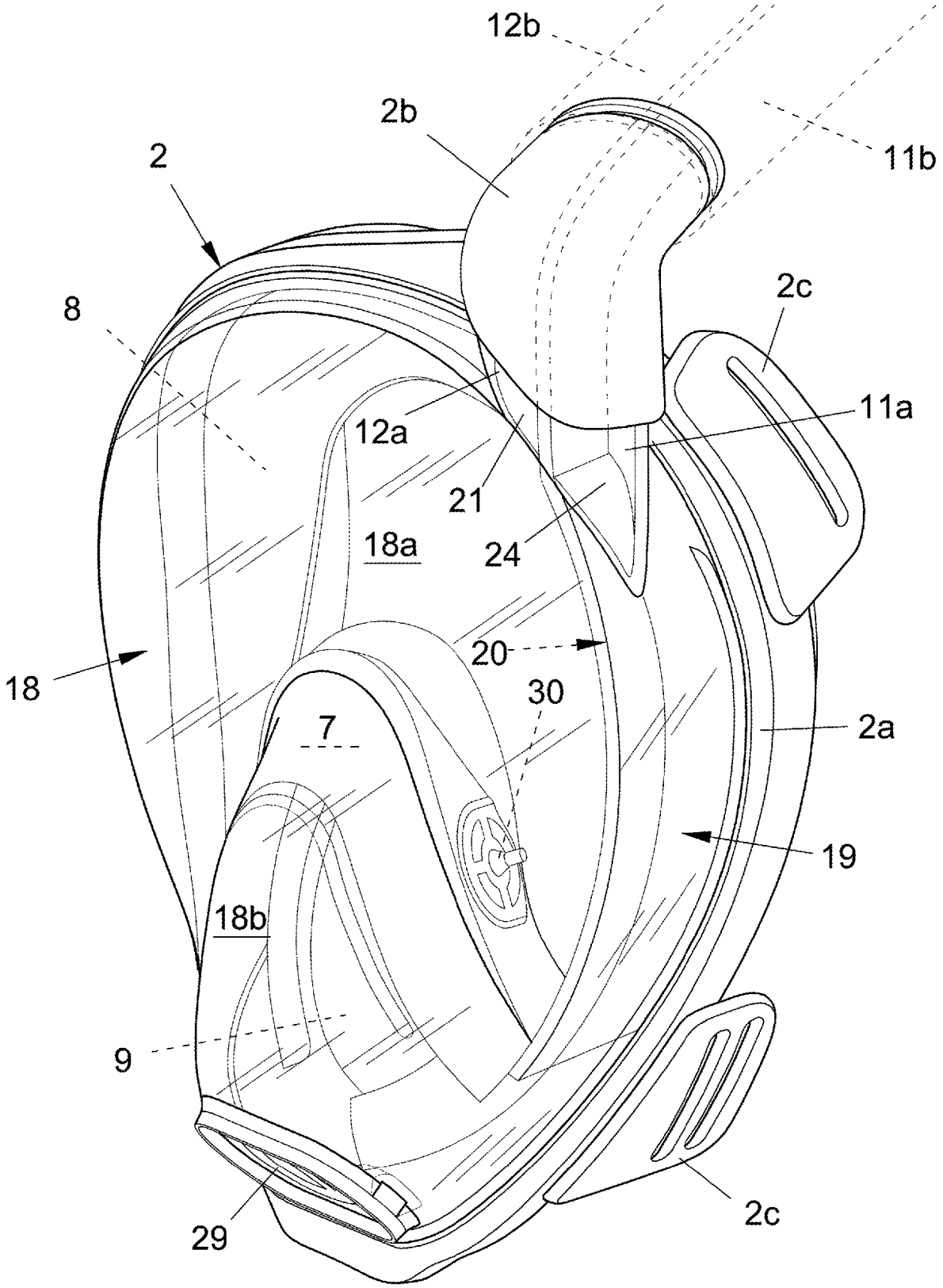
FIG. 2 shows a front perspective view of the mask.
Figure 3:
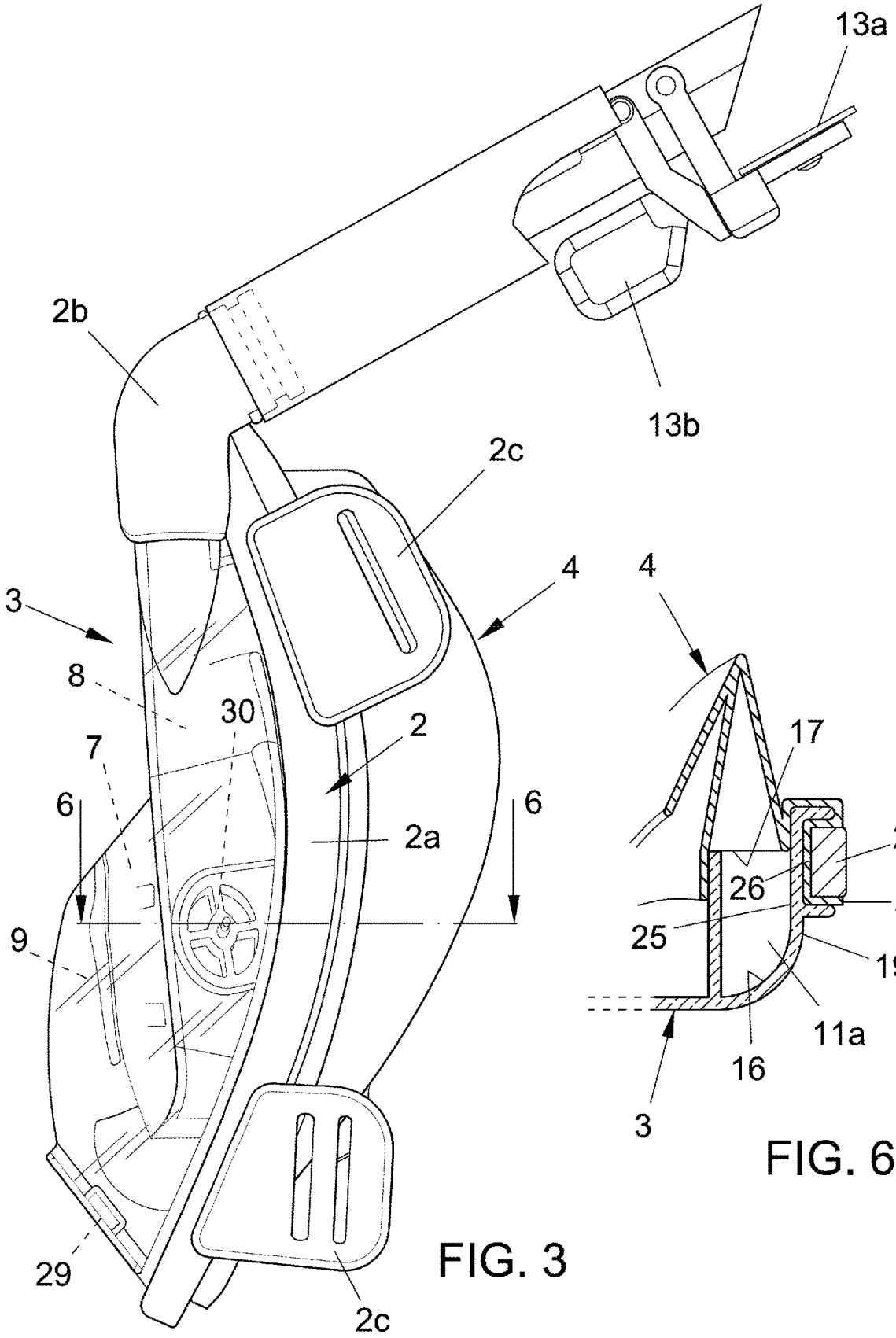
FIG. 3 shows a lateral elevation view of the mask.
Figure 6:
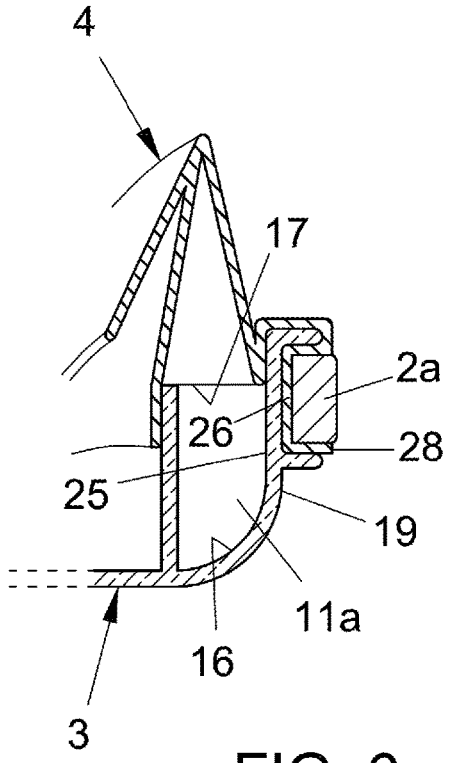
FIG. 6 shows a cross section of the breathing conduit, taken along line 6-6 of figure.
Figure 4:
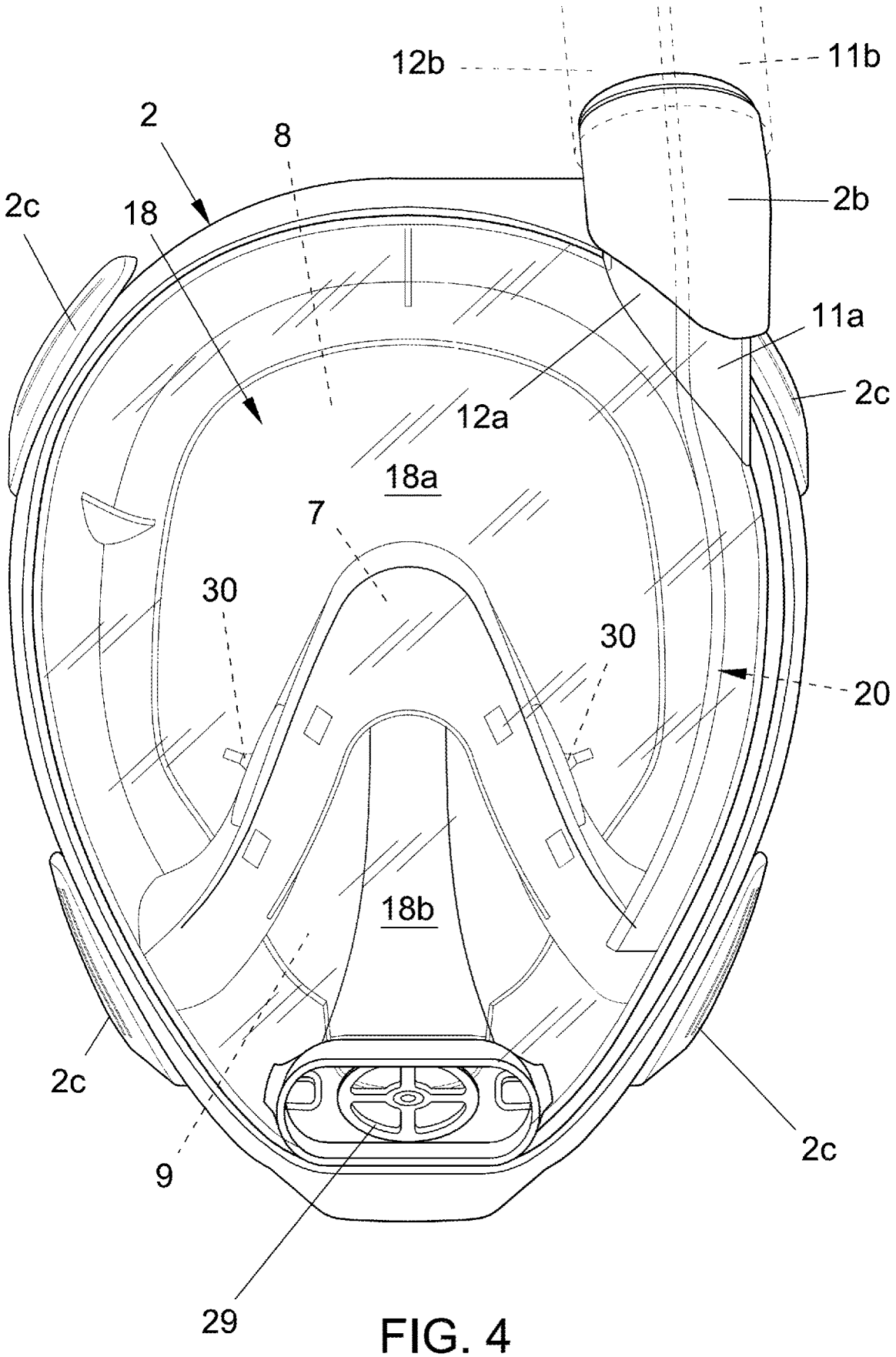
FIG. 4 shows a front view of the mask.
Figure 5:
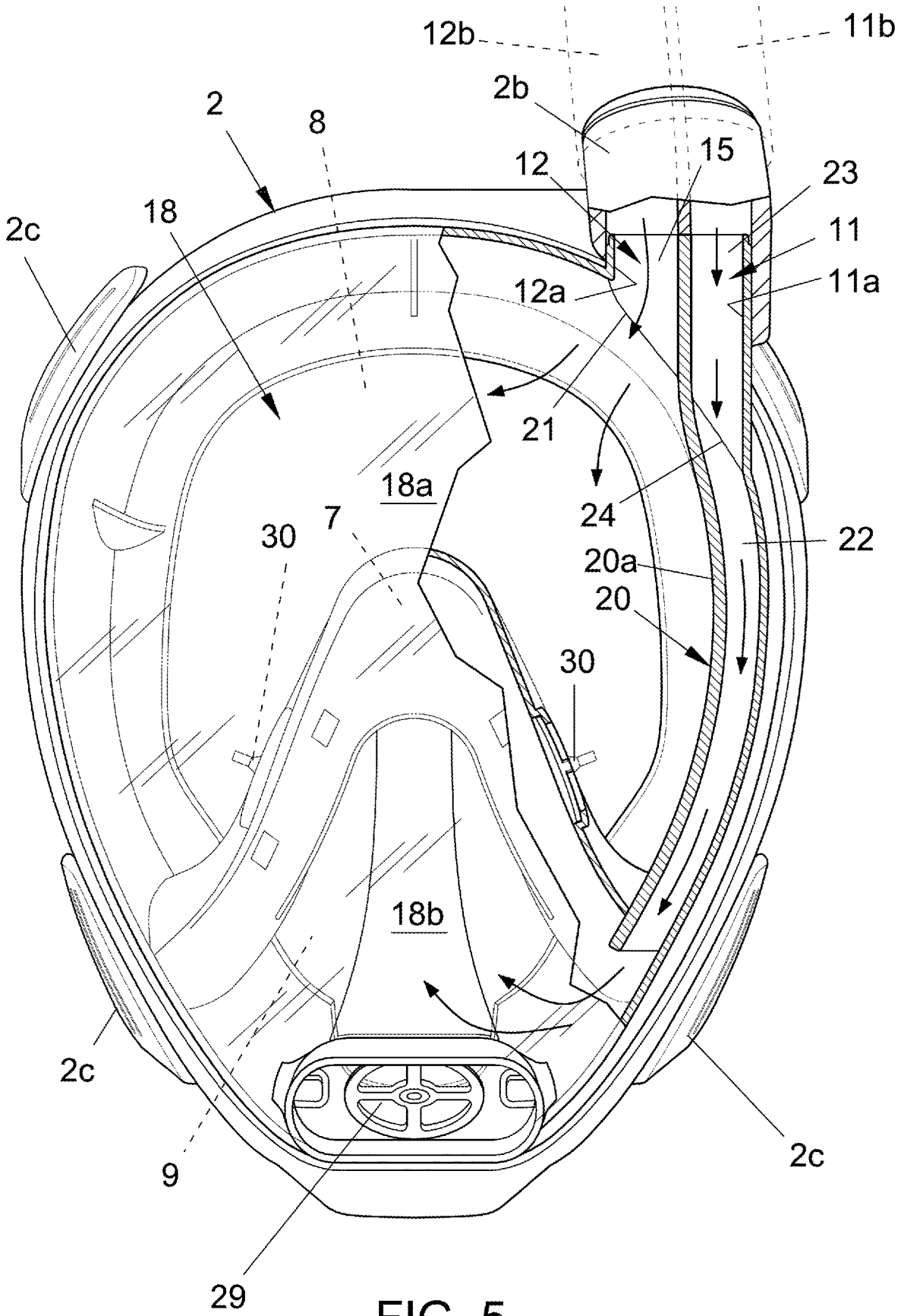
FIG. 5 shows a partially sectioned front view of the mask.
Figure 7:
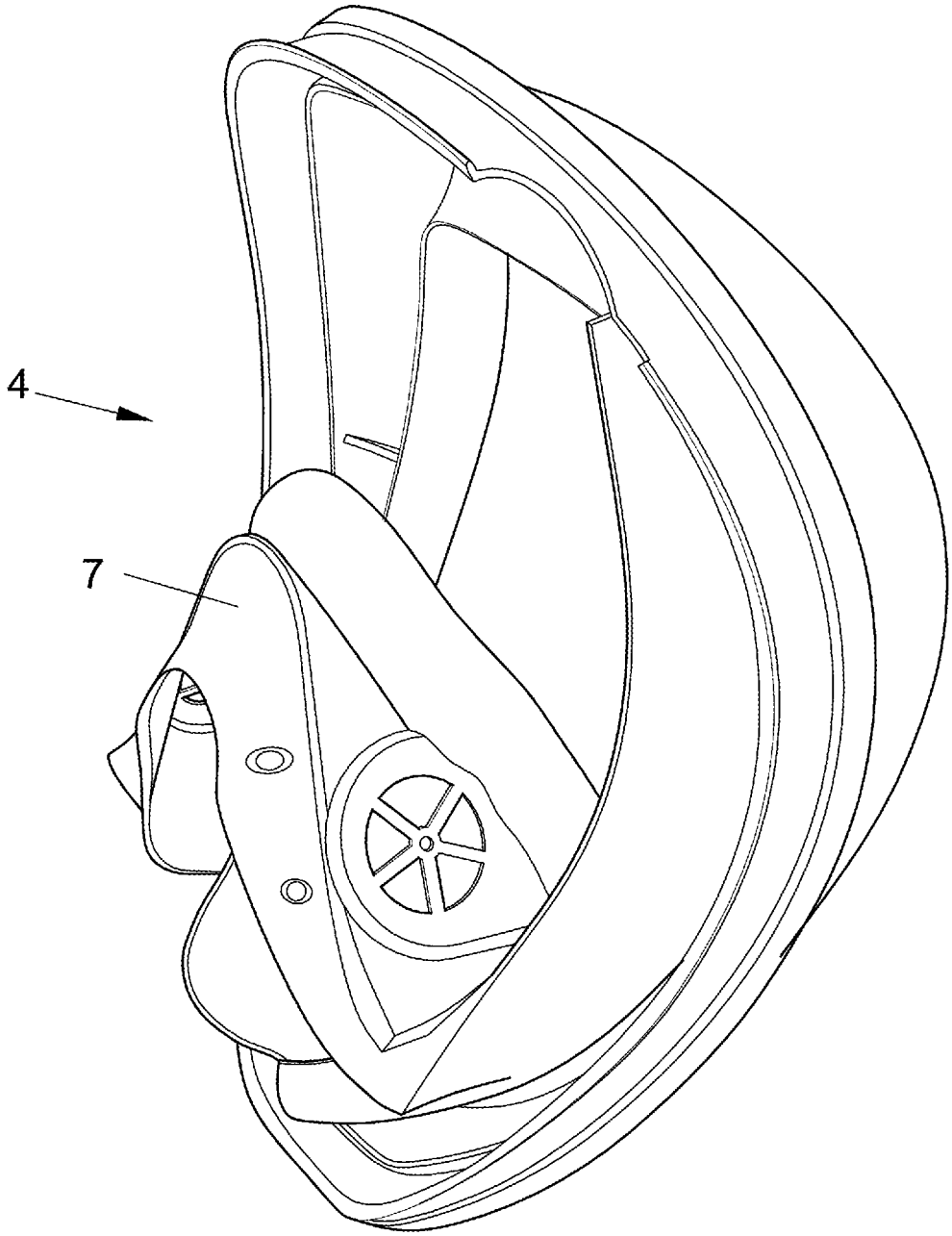
FIG. 7 shows the face mask of the mask.

With reference to the figures, a snorkeling mask 1 is shown, comprising a rigid frame 2, a transparent visor 3, a soft face mask 4 applicable in an airtight way to the face of the user, and a breathing circuit 5.

The face mask 4 has a closed ring-shaped band 6 adaptable to the oval of the user's face and a membrane 7, shaped in particular with an overturned V shape, which with the band 6 and the visor 3 delimits an upper viewing chamber 8 shaped to contain the eyes of the user and a lower breathing chamber 9 shaped to contain the nose and the mouth of the user.

The breathing circuit 5 is connected to the lower chamber 9. Advantageously the mask 1 also has a ventilation circuit 10 for ventilating the upper chamber 8 independent and separated from the breathing circuit 5.

The breathing circuit 5 comprises a first connecting conduit 11 for connecting the lower chamber 9 to the atmospheric environment external to the mask 1.

The ventilation circuit 10 comprises in turn a second connecting conduit 12 for connecting the upper chamber 8 to the atmospheric environment external to the mask 1.

The first conduit 11 and the second conduit 12 are equipped with floating shutter means for example of the type indicated in the figure with 13*a*, 13*b*. Advantageously, along its whole length the first conduit 11 has a free passage section 14 when the shutter means 13*a*, 13*b* are in the open position thus establishing a direct air connection of the lower chamber 9 with the atmospheric environment external to the mask 1. Advantageously, along its whole length the second conduit 12 also has a free passage section 15 when the shutter means 13*a*, 13*b* are in the open position thus establishing a direct air connection of the upper chamber 8 with the atmospheric environment external to the mask 1.

The second conduit 12 comprises a proximal part 12*a* that leads into the upper chamber 8 and a distal part 12*b* from the upper chamber 12.

The proximal part 12*a* of the second conduit 12 is made as a single piece with the visor 3 while the distal part 12*b* of the second conduit 12 is removably engaged with the proximal part 12*a* of the second conduit 12 and supports the shutter means 13*a*, 13*b*.

The first conduit 11 also comprises a proximal part 11*a* that leads into the lower chamber 9 and a distal part 11*b* from the lower chamber 11.

The proximal part 11*a* of the first conduit 11 comprises opposite grooves 16, 17 of the visor 3 and the face mask 4, while the distal part 11*b* of the first conduit 11 is removably engaged with the proximal part 11*a* of the first conduit 11 and supports the shutter means 13*a*, 13*b*.

In the illustrated case the first conduit 11 and the second conduit 12 are positioned laterally with respect to a central axis of symmetry of the visor 3 and are juxtaposed.

In particular, the distal part 11*b* of the first conduit 11 and the distal part 12*b* of the second conduit 12 are juxtaposed and share the shutter means that comprise a single shutter 13*a* operating both on the first conduit 11 and on the second conduit 12 and a single float 13*b* for activating the shutter 13*a*.

In a variant of the invention not shown, the first conduit 11 and the second conduit are in a remote position with respect to one another and in that case the shutter means comprise a shutter and a float dedicated to the first conduit 11 and a shutter and a float dedicated to the second conduit 12.

The position of the first conduit 11 and of the second conduit 12 may vary, for example the first conduit 11 and the second conduit 12 may be positioned at a central axis of symmetry of the visor 3 or laterally but on the opposite side with respect to a central axis of symmetry of the visor 3.

The visor 3 has in detail a front wall 18 and a lateral wall 19 that extends perimetrally and at the rear of the front wall 18.

The front wall 18 has a flat portion 18*a* that in cooperation with the band 6 and the membrane 7 delimits the upper chamber 8, and a portion 18*b*, concave on the side facing the face of the user during use which, still in cooperation with the band 6 and the membrane 7 delimits the lower chamber 9.

The proximal portion 12*a* of the second conduit 12 in particular is fully external to the visor 3 and leads into a through hole 21 in the lateral wall 19 of the visor 3 that opens onto the upper chamber 8. The proximal portion 11*a* of the first conduit 11 has a stretch 22 internal to the visor 3 defined by the grooves 16, 17 and a stretch 23 external to the visor 3.

The stretch 22 internal to the visor 3, which leads into the lower chamber 9, and the stretch 23 external to the visor 3 are connected by a through hole 24 in the lateral wall 19 of the visor 3.

The groove 17 in the visor 3 is delimited by a partition 20 that extends at the rear from the flat portion 18*a* of the front wall 18.

The partition 20 has a plate-shaped longitudinal body oriented orthogonally to the flat portion 18*a*.

The partition 20 extends with a first part 20*a* thereof along a perimetral stretch of the flat portion 18*a* of the front wall 18 and with a second part 20*b* thereof beyond the flat portion 18*a* of the front wall 18.

The first part 20*a* of the partition 20 delimits the groove 17 in cooperation with the stretch of the lateral wall 19 which it faces.

The second part 20*b* of the partition 20, which intersects the lateral wall 19 between the through holes 21, 24, separates the proximal portion 12*a* of the second conduit 12 from the stretch 23 external to the visor 3 of the proximal portion 11*a* of the first conduit 11.

Along the external perimetral edge of the lateral wall 19 of the visor 3 a groove 25 is formed for housing a perimetral lip 26 of the face mask 4.

The perimetral lip 26 of the face mask 4 has, on the opposite side to the lateral wall 19 of the visor 3, a perimetral groove 28 for housing the frame 2.

The frame 2 in particular comprises a clamping profile 2*a* housed in the perimetral groove 28 of the perimetral lip 26 of the face mask 4, a connection fitting 2*b* between each proximal part 11*a*, 12*a* and the corresponding distal part 11*b*, 12*b* of the first conduit 11 and of the second conduit 12, and of the attachments 2*c* for elastic bands (not shown) for retaining the mask 1 on the user's face.

To improve comfort, a system is also provided for draining the water which during use of the mask 1 can penetrate into the visor 3, both into the upper chamber 8 and into the lower chamber 9.

The water drainage system comprises a check valve 29 on the visor 3 in the bottom part of the lower chamber 9 and one or more check valves 30 on the membrane 7, for example two check valves 30 positioned symmetrically on opposite sides of the membrane 7.

The check valve 29 allows the drainage of the water from the lower chamber 9 to the atmospheric environment external to the mask 1, while the valves 30 allow the drainage of water from the upper chamber 8 to the lower chamber 9.

The check valves 29, 30 comprise a membrane shutter that bends under the action of the weight of the water.

The operation of the mask 1 is briefly as follows.

During surface swimming the shutter 13*a* remains open, so that the first conduit 11 maintains the lower chamber 9 in direct communication with the external atmospheric environment to allow breathing that takes place through the first conduit 11 both for breathing in and for breathing out.

Furthermore, as the shutter 13*a* remains open during surface swimming, the second conduit 12 maintains in direct communication the upper chamber 8 with the external atmospheric environment to prevent the fogging of the visor 3 precisely in the area in front of the user's eyes.

When the user's head is occasionally submerged, the shutter 13*a* pushed by the float 13*b* closes the first conduit 11 and the second conduit 12 hence preventing the access of water into the lower chamber 9 and into the upper chamber 8 of the visor 3.

The mask for surface snorkeling as conceived herein is susceptible of many modifications and variants, all falling within the scope of the inventive concept; furthermore, all the details are replaceable by technically equivalent elements.

The invention claimed is:

1. A mask (1) for surface snorkeling comprising a rigid frame (2), a transparent visor (3), a soft face mask (4) applicable in an airtight way to a face of a user and having a membrane (7) which delimits an upper viewing chamber (8) shaped to contain eyes of a user and a lower breathing chamber (9) shaped to contain a nose and mouth of said user, and a breathing circuit (5) connected to said lower chamber (9), wherein:

the mask (1) comprises a ventilation circuit of said upper chamber (8) independent and separated from said breathing circuit (5);

said visor (3) has a front wall (18) having a flat portion (18*a*) which delimits said upper chamber (8) and an inwardly concave portion (18*b*) which delimits said lower chamber (9), and a lateral wall (19) which extends perimetrally and at a rear of said front wall (18);

said face mask (4) has a perimetral lip (26) and where, along an external perimetral edge of said lateral wall (19), a groove (25) is formed to house said perimetral lip (26);

said perimetral lip (26) has a perimetral groove (28) to house said frame (2);

said frame (2) comprises a clamping profile (2*a*) housed in said perimetral groove (28) of said perimetral lip (26); and said clamping profile (2*a*) comprises a connection fitting (2*b*) between said proximal part (11*a*, 12*a*) and said distal part (11*b*, 12*b*) of said first and said second conduits (11, 12).

2. The mask (1) for surface snorkeling according to claim 1, wherein said breathing circuit (5) comprises a first connecting conduit (11) connecting said lower chamber (9) to the atmospheric environment external to the mask (1), and said ventilation circuit comprises a second connecting conduit (12) connecting said upper chamber (8) to the atmospheric environment external to the mask (1), wherein said first and said second conduits (11, 12) are equipped with a floating shutter (13*a*, 13*b*).

3. The mask (1) for surface snorkeling according to claim 2, wherein said first conduit (11) has a passage section which is free for its entire length when said floating shutter (13*a*, 13*b*) is in an open position, thus establishing a direct air connection of said lower chamber (9) to the atmospheric environment external to the mask.

4. The mask (1) for surface snorkeling according to claim 2, wherein said second conduit (12) has a passage section which is free for its entire length when said floating shutter (13*a*, 13*b*) is in an open position, thus establishing a direct air connection of said upper chamber (8) to the atmospheric environment external to the mask (1).

5. The mask (1) for surface snorkeling according to claim 2, wherein said second conduit (12) comprises a proximal part (12*a*) which opens in said upper chamber (8) and a distal part (12*b*) from said upper chamber (8), wherein said proximal part (12*a*) is made in a single piece with said visor (3) and said distal part (12*b*) is removably engaged with said proximal part (12*a*) and supports a floating shutter (13).

6. The mask (1) for surface snorkeling according to claim 2, wherein said first and said second conduits (11, 12) are juxtaposed.

7. The mask (1) for surface snorkeling according to claim 2, wherein said first and said second conduits (11, 12) are positioned laterally with respect to a central axis of symmetry of said visor (3).

8. The mask (1) for surface snorkeling according to claim 1, wherein at said lower chamber (9) said visor (3) has at least a valve (29) to drain water from said lower chamber (9) external to said mask (1).

9. The mask (1) for surface snorkeling according to the claim 8, wherein said membrane (7) has at least a valve (30) to drain water from said upper chamber (8) to said lower chamber (9).

10. A mask (1) for surface snorkeling comprising a rigid frame (2), a transparent visor (3), a soft face mask (4) applicable in an airtight way to a face of a user and having a membrane (7) which delimits an upper viewing chamber (8) shaped to contain eyes of a user and a lower breathing chamber (9) shaped to contain a nose and mouth of said user, and a breathing circuit (5) connected to said lower chamber (9), wherein:

the mask (1) comprises a ventilation circuit (10) of said upper chamber (8) independent and separated from said breathing circuit (5);

said breathing circuit (5) comprises a first connecting conduit (11) connecting said lower chamber (9) to the atmospheric environment external to the mask (1), and said ventilation circuit (10) comprises a second connecting conduit (12) connecting said upper chamber (8) to the atmospheric environment external to the mask (1);

said first and said second conduits (11, 12) are equipped with a floating shutter (13*a*, 13*b*); and said first conduit (11) comprises a proximal part (11*a*) which opens in said lower chamber (9) and a distal part (11*b*) from said lower chamber (9), wherein said proximal part (11*a*) comprises walls of said visor (3) and said face mask (4), and said distal part (11*b*) is removably engaged with said proximal part (11*a*) and supports said floating shutter (13*a*, 13*b*).

11. The mask (1) for surface snorkeling according to claim 10, wherein said visor (3) has a front wall (18) having a flat portion (18*a*) which delimits said upper chamber (8) and an inwardly concave portion (18*b*) which delimits said lower chamber (9), and a lateral wall (19) which extends perimetrally and at a rear of said front wall (18), wherein said groove (17) in said visor (3) is delimited by a partition (20) that extends from said flat portion (18*a*).

12. The mask (1) for surface snorkeling according to claim 11, wherein said partition (20) extends along a perimetral stretch of said flat portion (18*a*).

13. The mask (1) for surface snorkeling according to claim 11, wherein said partition (20) extends externally to said visor (3).

14. The mask (1) for surface snorkeling according to claim 13, wherein, externally to said visor (3), said partition (20) defines a separation wall between said first and said second conduits (11, 12).

15. The mask (1) for surface snorkeling according to claim 10, wherein said visor (3) has a front wall (18) having a flat portion (18*a*) which delimits said upper chamber (8) and an inwardly concave portion (18*b*) which delimits said lower chamber (9), and a lateral wall (19) which extends perimetrally and at a rear of said front wall (18), wherein said face mask (4) has a perimetral lip (26) and wherein, along the external perimetral edge of said lateral wall (19), a groove (25) is formed to house said perimetral lip (26).

16. The mask (1) for surface snorkeling according to claim 15, wherein said lip (26) has a perimetral groove (28) to house said frame (2).

17. The mask (1) for surface snorkeling according to claim 16, wherein said frame (2) comprises a clamping profile (2*a*) housed in said perimetral groove of said perimetral lip (26).

18. The mask (1) for surface snorkeling according to claim 17, wherein said clamping profile (2*a*) comprises a connection fitting (2*b*) between said proximal part (11*a*, 12*a*) and said distal part (11*b*, 12*b*) of said first and said second conduits (11, 12).

19. The mask (1) for surface snorkeling according to claim 10, wherein said first conduit (11) has a passage section which is free for its entire length when said floating shutter (13*a*, 13*b*) is in an open position, thus establishing a direct air connection of said lower chamber (9) to the atmospheric environment external to the mask.

20. The mask (1) for surface snorkeling according to claim 10, wherein said second conduit (12) has a passage section which is free for its entire length when said floating shutter (13*a*, 13*b*) is in an open position, thus establishing a direct air connection of said upper chamber (8) to the atmospheric environment external to the mask (1).

* * * * *